United States Patent [19]

Schank et al.

[11] 4,263,388

[45] Apr. 21, 1981

[54] ELECTROPHOTOGRAPHIC IMAGING DEVICE

[75] Inventors: Richard L. Schank, Webster; John M. Pochan, Ontario, both of N.Y.

[73] Assignee: Xerox Corporation, Stamford, Conn.

[21] Appl. No.: 100,167

[22] Filed: Dec. 4, 1979

[51] Int. Cl.[3] ..... G03G 5/06; G03G 5/04; G03G 5/14

[52] U.S. Cl. ..... 430/59; 430/58; 430/84; 430/85; 430/86; 430/96

[58] Field of Search ..... 430/58, 59, 96, 84, 430/85, 86

[56] References Cited

U.S. PATENT DOCUMENTS

| | | | |
|---|---|---|---|
| 3,121,006 | 2/1964 | Middleton et al. | 430/87 |
| 3,453,106 | 7/1969 | Teague | 430/96 |
| 3,850,630 | 11/1974 | Regensburger et al. | 430/58 |
| 3,899,328 | 8/1975 | Limburg | 430/58 |
| 4,115,116 | 9/1978 | Stolka et al. | 430/59 |

*Primary Examiner*—Mary F. Downey

*Attorney, Agent, or Firm*—Harvey M. Brownrout; Peter H. Kondo; James P. O'Sullivan

[57] ABSTRACT

An imaging member comprising a charge generation layer comprising a layer of photoconductive material and a contiguous charge transport layer of a charge transport material dissolved in a polymer of the following structure:

wherein R', R'', R''' and R'''' are independently selected from the group consisting of alkyl and alkylene groups having from 1 to 12 carbon atoms, there being no more than 1 alkylene group present, x is from 4 to 5, y is from 0 to 1, n is a whole number and said polymer has a molecular weight ranging from about 1500 to about 120,000, said transport layer being substantially nonabsorbing in the spectral region at which the photoconductive layer generates and injects photogenerated holes, but is capable of supporting the injection of photogenerated holes from said photoconductive layer and transporting said holes through said charge transport layer.

5 Claims, 1 Drawing Figure

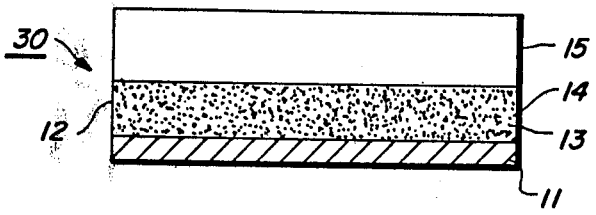
30
15
14
12
13
11

ELECTROPHOTOGRAPHIC IMAGING DEVICE

BACKGROUND OF THE INVENTION

This invention relates in general to xerography and more specifically to a novel photosensitive device.

In recent years, interest has been shown in flexible electrophotographic plates for use in high speed office copying machines. Some of these plates are multilayered devices comprising, a conductive substrate layer, an adhesive-blocking interface layer, a charge generation layer and a charge transport layer. The charge transport layer comprises an organic charge transport molecule dissolved in a polymeric matrix material. This layer is substantially nonabsorbing in the spectral region of intended use, i.e. visible light, but is "active" in that it allows (1) injection of photogenerated holes from the charge generation layer and (2) efficient transport of these charges to the surface of the transport layer to discharge a surface charge thereon.

These endless flexible electrophotographic members are intended to be moved at fairly high speeds, e.g. 5–15 inches per second, and flexed around small diameter support and driving members for thousands of cycles so that they are subjected to a variety of different forces and stresses in different directions. It follows that the materials employed in the multilayered structure and the interfacial bonds between layers must be able to easily withstand these stresses and forces without rupture or delamination.

OBJECTS OF THE INVENTION

It is therefore an object of this invention to provide a novel photosensitive device capable of easily withstanding the forces and stresses involved in employing a high speed machine.

It is a further object of this invention to provide an electrophotographic device employing a superior class of organic polymer as the matrix material in one of the layers thereof.

PRIOR ART STATEMENT

In U.S. Pat. No. 4,115,116 there is disclosed classes of inactive resinous materials which can be employed as the polymeric matrix material into which is dissolved a charge transport compound in forming the charge transport layer of an electrophotographic imaging member. It is believed that this is the prior art most pertinent to the instant invention.

SUMMARY OF THE INVENTION

The foregoing objects and others are accomplished in accordance with this invention by providing a photoconductive member having at least two operative layers. The first layer comprises a layer of photoconductive material which is capable of photogenerating and injecting photogenerated holes into a contiguous or adjacent charge transport layer. The charge transport layer comprises a charge transport material dissolved in a polymer of the following structure:

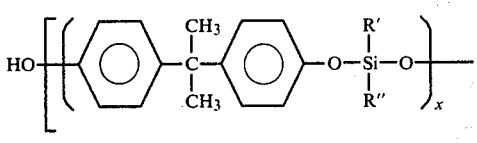

-continued

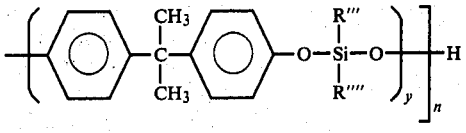

wherein R′, R″, R‴ and R⁗ are independently selected from the group consisting of alkyl and alkylene groups having from 1 to 12 carbon atoms and having no more than 1 alkylene group present, x is from 4 to 5, y is from 0 to 1, n is a whole number and said polymer has a molecular weight ranging from about 1500 to about 120,000. Examples of alkyl groups contemplated are methyl, ethyl, propyl, n-butyl, isobutyl, ethylhexyl, n-octyl, decyl, dodecyl, etc. Examples of alkylene groups include vinyl and its longer chain counterparts. These polymers can be termed the product of siloxy coupled diols. The charge transport layer is substantially nonabsorbing in the spectral region at which the photoconductive layer generates and injects photogenerated holes, but is capable of supporting the injection of photogenerated holes from said photoconductive layer and transporting said holes through said charge transport layer. The charge transport layer is comprised of said polymer with from about 25 to about 75 percent by weight of a charge transport compound dissolved therein.

BRIEF DESCRIPTION OF THE DRAWING

The FIGURE is a schematic illustration of one of the members of the instant invention which comprise a photoreceptor having a charge generation overcoated with a charge transport layer.

DETAILED DESCRIPTION OF THE DRAWING

Referring to the FIGURE, reference character 30 designates an imaging member which comprises a supporting substrate 11 having a charge generation layer 12 thereon. Substrate 11 is preferably comprised of any suitable conductive material. Typical conductors comprise aluminum, steel, nickel, brass or the like. The substrate may be rigid or flexible and of any convenient thickness. Typical substrates include flexible belts made of sleeves, sheets, webs, plates, cylinders and drums. The substrate or support may also comprise a composite structure such as a thin conductive coating contained on a paper base; a plastic coated with a thin conductive layer such as aluminum, nickel or copper iodide; or glass coated with a thin conductive coating of chromium or tin oxide.

In addition, if desired, an electrically insulating substrate may be used. In this case, an electric charge equivalent to a conductive layer, may be placed upon the insulating member by double corona charging techniques well known and disclosed in the art. Other modifications using an insulating substrate or no substrate at all include placing the imaging member on a conductive backing member or plate in charging the surface while in contact with said backing member. Subsequent to imaging, the imaging member may then be stripped from the conductive backing.

Generator layer 12 contains photoconductive particles 13 dispersed randomly without orientation in binder 14. Binder material 14 may comprise any electrically insulating resin such as those disclosed in Middleton et al U.S. Pat. No. 3,121,006. Specific examples are polystyrene, acrylic and methacrylic ester polymers, polyvinyl chlorides, etc. When using an electrically inactive or insulating resin, it is essential that there be particle-to-particle contact between the photoconductive particles. This necessitates that the photoconductive material be present in an amount of at least 10 percent by volume of the binder layer with no limit on the maximum amount of photoconductor in the binder layer. If the matrix or binder comprises an active material, e.g. poly-N-vinyl carbazole, the photoconductive material need only comprise about 1 percent or less by volume of the binder layer with no limit on the maximum amount of photoconductor in the binder layer. The thickness of binder layer 12 is not critical. Layer thicknesses from about 0.05 to 40.0 microns have been found to be satisfactory.

The photoconductive particles 13 may be any material capable of photogenerating holes and injecting photogenerated holes into the contiguous charge transport layer 15. Any suitable inorganic or organic photoconductor and mixtures thereof may be employed. Inorganic materials include inorganic crystalline photoconductive compounds and inorganic photoconductive glasses. Typical inorganic compounds include cadmium sulfoselenide, cadmium selenide, cadmium sulfide and mixtures thereof. Typical inorganic photoconductive glasses include amorphous selenium and selenium alloys such as selenium-tellurium, selenium-tellurium-arsenic and selenium-arsenic and mixtures thereof. Selenium may also be used in a crystalline form known as trigonal selenium. Typical organic photoconductive materials which may be used as charge generators include phthalocyanine pigment such as the X-form of metal-free phthalocyanine described in U.S. Pat. No. 3,357,989 to Byrne et al; metal phthalocyanines such as copper phthalocyanine, quinacridones, available from duPont under the tradename Monastral Red, Monastral Violet and Monastral Red Y; substituted 2,4-diaminotriazines disclosed by Weinberger in U.S. Pat. No. 3,445,227; triphenodioxazines disclosed by Weinberger in U.S. Pat. No. 3,442,781; polynuclear aromatic quinones available from Allied Chemical Corporation under the tradename Indo Double Scarlet, Indofast Violet Lake B, Indofast Brilliant Scarlet and Indofast Orange. The photoconductive particles may be present in the generator layer in from 0.5 percent to about 95 percent by volume depending upon the character of the binder materials.

It is to be understood that the generator layer need not be photoconductive particles dispersed in a resin binder, but can be a homogeneous layer, such as amorphous selenium, selenium alloys, for example, selenium-tellurium-arsenic alloys and, in fact, any other charge generating photoconductive material which can withstand a minimum flexing stress required in a flexible photoreceptor.

Active layer 15 comprises a transparent electrically inactive copolymer of the type described above having dispersed therein from about 25 to about 75 percent by weight of a charge transport material. The charge transport material can be any material capable of supporting the injection of photogenerated holes from the photoconductive layer and transporting said holes through said charge transport layer. Typical charge transport materials include N,N'-diphenyl-N,N'-bis(phenylmethyl)-[1,1'-biphenyl]-4,4'-diamine; N,N'-bis(3-methylphenyl)-N,N'-bis[4-(1-butyl)-phenyl]-; and N,N,N',N'-tetra-(3-methylphenyl)-[2,2'-dimethyl-1,1'-bisphenyl]-4,-4'-diamine; bis(4-diethylamino-2-methylphenyl) phenyl methane; and N,N'-diphenyl-N,N'-bis(alkylphenyl)-[1,1'-biphenyl]-4,4'-diamine wherein the alkyl group is selected from the group consisting of a lower alkyl group having from 1 to 4 carbon atoms. In general, any efficient hole transport compound which can be effectively dissolved in the polymer described above can be employed in the charge transport layer.

The preferred siloxy polymers of bisphenol A, i.e. 2,2'-bis(4-hydroxyphenyl) propane, for the transport layer 15 have a molecular weight of from about 1500 to about 120,000 or more. A material most preferred as the electrically inactive resinous material is poly(oxy,dimethylsilyl,oxy,1,4-phenylene, isopropylidene,1,4-phenylene).

The charge transport small molecules contemplated by the present invention show excellent solubility in the silane copolymers. These compounds can be dissolved in the polymers in a range of from about 25 to about 75 percent by weight. The siloxy polymers of the instant invention can also be used as the matrix material in the charge generator layer.

The copolymers contemplated are soluble in a wide variety of non-acid type solvents. Examples of these solvents are benzene, toluene, cyclohexane, cyclohexanone, other cycloaliphatic solvents and various mixtures thereof. This permits the avoidance of acidic type solvents, such as methylene chloride which tends to adversely affect the charge transport molecule. These copolymers have a low free surface energy e.g. about 24 dynes/cm$^2$, which is ideal for removing residual toner image from the surface of the photoreceptor.

Active layer 15 as described above, is substantially nonabsorbing to light in the wavelength region employed to generate holes in the photoconductive layer. The preferred range for xerographic utility is from about 4000 to about 8000 angstrom units. All photoconductor-active material combinations of the instant invention shall result in the injection and subsequent transport of holes across the physical interface between the photoconductor and the active material. In general, the thickness of active layer 15 is from about 5 to 100 microns, but thicknesses outside this range can also be used.

EXAMPLE I

In a 250 ml, three necked flask equipped with a stirrer, dropping funnel, thermometer, water condenser and heating mantle is placed 22.8 grams of bisphenol-A(0.10 moles) in 27.9 mls of dry toluene. While stirring, the following feed was added dropwise at a steady rate over a period of 30 minutes: 22.8 grams (0.088 moles) of $(CH_3)_2\ Si[N(CH_3)_2]_2$ and 0.32 grams (0.002 moles) of $(CH_3)\ (CH_2{=}CH)\ Si[N(CH_3)_2]_2$. An exotherm to 40°–42° C. was noted along with the evolution of $(CH_3)$ NH gas. The bisphenol-A was gradually pulled into solution during this initial addition/reaction step. At the conclusion of the addition step, the reaction mixture was gradually heated to a gentle reflex (110° C.), held for 6 hours and then cooled. After filtration, the copolymer solution was ready for use. A film cast on a glass slide dried to a clear hard, tough adhesive film. The polymer structure is as follows:

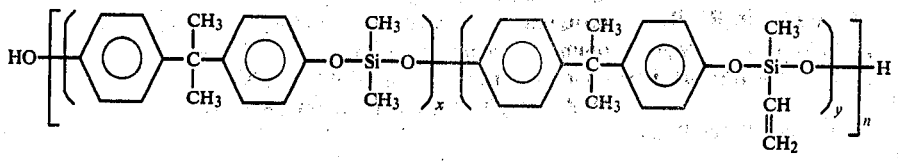

wherein x and y are in a ratio corresponding to the mole quantities of the reactants given above. This polymer has a molecular weight of about 2000 and a Tg of about 30° C.

EXAMPLE II

A one micron layer of amorphous selenium is vacuum evaporated on a 3 mil aluminum substrate by a conventional vacuum deposition technique such as that disclosed in U.S. Pat. No. 2,753,278. Vacuum deposition is carried out at a vacuum of $10^6$ Torr, while the substrate is maintained at a temperature of about 50° C. To 4.0 mls of toluene was added 0.5 ml of a 50 weight percent solution of the polymer of Example I in toluene. In this solution was dissolved 0.29 grams of N,N'-diphenyl-N,N'-bis(3-methylphenyl)-[1,1'-biphenyl]-4,4'-diamine. This was cast onto the surface of the amorphous selenium using an 8 mil doctor blade. This structure was dried overnight in vacuum at 40° C. The dried transport layer is a 40/60 (weight/percent) diamine/polymer film.

This device was tested electrically by corona charging it negatively to 1000 volts and subjecting it to a light flash of 4330 Angstrom wavelength and approximately 15 ergs/cm$^2$ intensity. The device discharged completely instantaneously. Devices of this type will make excellent images.

EXAMPLE III

In a one quart Waring Blender jar equipped with a power base, dropping funnel, thermometer, heating tape and a temperature control, is placed 45.6 grams (0.20 moles) of bisphenol A, 69.3 ml of dry toluene and 39.3 ml of dry pyridine. The solubilized blender jar contents are heated to 45°-50° C. and violently agitated. The temperature is raised to 50°-60° C. while 27.0 grams (0.21 moles) of $(CH_3)_2SiCl_2$ is slowly added dropwise over a period of about 45 minutes. The charge is stirred an additional 15 minutes at about 50° C. 400 mls of toluene are added and the mixture cooled to about 30° C. An additional 320 mls of toluene are added. The pyridine hydrochloride is removed by filtration. The filtrate is washed twice with 400 ml of a 2 percent $HCl/H_2O$ solution and separated. This is washed twice with 400 ml of a 2 percent $NaHCO_3/H_2O$ solution and separated. This is washed twice with 400 ml of $H_2O$ to neutral pH and separated. This is then dried over $Na_2SO_4$ and filtered through a No. 4 Whitman paper. A portion is used to solvent cast a film which is air dried and placed in a vacuum oven at 100° C. for 3 hours. The result was a clear, free standing polymer film having the following structure:

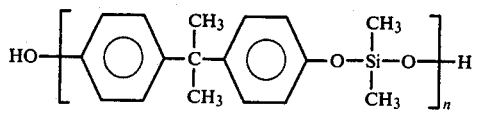

This polymer has a molecular weight of 119,250 and a Tg of 56.0° C.

EXAMPLE IV

A one micron layer of amorphous selenium is vacuum evaporated on a 3 mil aluminum substrate as in Example II. To 4.0 mls of toluene was added 0.5 ml of a 50 weight percent solution of the polymer of Example III in toluene. In this solution was dissolved 0.29 grams of bis(4-diethylamino-2-methylphenyl)phenylmethane. This was cast onto the surface of the amorphous selenium using an 8 mil doctor blade. This structure was dried overnight in vacuum at 40° C. The dried transport layer is a 40/60 (weight percent) charge transport compound of polymer film.

This device was tested electrically by corona charging it negatively to 1000 volts and subjecting it to a light flash of 4330 Angstrom wavelength and approximately 15 ergs/cm$^2$ intensity. The device discharged completely instantaneously. This device was employed to make excellent reproductions of a Xerox Model D copier.

Other modifications and ramifications of the present invention will appear to those skilled in the art upon reading the disclosure. These are also intended to be within the scope of the invention.

What is claimed is:

1. An imaging member comprising a charge generation layer comprising a layer of photoconductive material and a contiguous charge transport layer of a charge transport material dissolved in a polymer of the following structure:

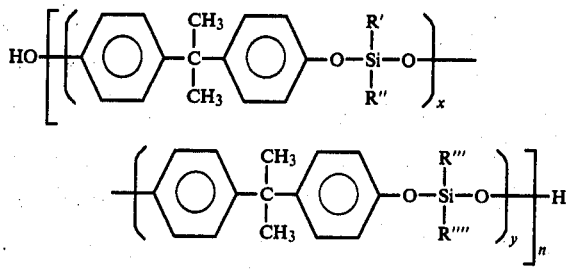

wherein R', R'', R''' and R'''' are independently selected from the group consisting of alkyl and alkylene groups having from 1 to 12 carbon atoms, there being no more than 1 alkylene group present, x is from 4 to 5, y is from 0 to 1, n is a whole number and said polymer has a molecular weight ranging from about 1500 to about 120,000, said transport layer being substantially nonabsorbing in the spectral region at which the photoconductive layer generates and injects photogenerated holes, but is capable of supporting the injection of photogenerated holes from said photoconductive layer and transporting said holes through said charge transport layer.

2. The imaging member of claim 1 wherein said charge transport material is dissolved in said polymer in an amount of from about 25 to about 75 percent by weight.

3. The imaging member of claim 1 wherein R′, R″ and R‴ are methyl groups and R⁗ is a vinyl group.

4. The imaging member of claim 1 wherein R′, R″, R‴ and R⁗ are all methyl groups.

5. The member of claim 1 wherein the photoconductive material is selected from the group consisting of amorphous selenium, trigonal selenium, a selenium tellurium alloy, a selenium tellurium arsenic alloy, a selenium arsenic alloy and mixtures thereof and wherein the charge transport material is N,N′-diphenyl-N,N′-bis(3-methylphenyl)-[1,1′-biphenyl]-4,4′-diamine.

* * * * *

UNITED STATES PATENT AND TRADEMARK OFFICE

CERTIFICATE OF CORRECTION

PATENT NO. : 4,263,388

DATED : April 21, 1981

INVENTOR(S) : Richard L. Schank et al

It is certified that error appears in the above-identified patent and that said Letters Patent are hereby corrected as shown below:

First page, Column 2, line 15: "alkylene" should read --alkenyl--.

First page, Column 2, line 17, "alkylene" should read --alkenyl--.

Column 2, line 9, "alkylene" should read --alkenyl--.

Column 2, line 11, "alkylene" should read --alkenyl--.

Column 2, line 17, "alkylene" should read --alkenyl--.

Claim 1, line 55, "alkylene" should read --alkenyl--.

Claim 1, line 57, "alkylene" should read --alkenyl--.

Signed and Sealed this

*Sixteenth* Day of *November 1982*

[SEAL]

*Attest:*

GERALD J. MOSSINGHOFF

*Attesting Officer*

*Commissioner of Patents and Trademarks*